US005421510A

United States Patent [19]

Calvert

[11] Patent Number: 5,421,510

[45] Date of Patent: Jun. 6, 1995

[54] CONTAINER/LID ASSEMBLY FOR PAPERBOARD FOOD PACKAGES WHICH UTILIZES PRESS-APPLIED COATINGS AS A SEALING MEDIUM

[75] Inventor: Barry G. Calvert, Covington, Va.

[73] Assignee: Westvaco Corporation, New York, N.Y.

[21] Appl. No.: 258,276

[22] Filed: Jun. 10, 1994

[51] Int. Cl.[6] ..... B65D 1/36; B65D 43/02

[52] U.S. Cl. ..... 229/125.35; 229/3.1; 229/104; 229/903; 229/905

[58] Field of Search ..... 229/125.35, 104, 2.5 R, 229/3.1, 903, 905, 906

[56] References Cited

U.S. PATENT DOCUMENTS

| | | | |
|---|---|---|---|
| 3,391,847 | 7/1968 | Christine et al. | 229/125.35 |
| 3,495,758 | 2/1970 | Wienecke, Jr. | 229/125.35 |
| 4,252,268 | 2/1981 | Haire . | |
| 4,656,068 | 4/1987 | Raines | 229/125.35 |
| 4,951,868 | 8/1990 | Model | 229/125.35 |
| 4,962,849 | 10/1990 | Anderson . | |
| 5,029,750 | 7/1991 | Artusi . | |
| 5,090,615 | 2/1992 | Hopkins et al. . | |
| 5,125,529 | 6/1992 | Torterotot . | |
| 5,234,159 | 8/1993 | Lorence et al. . | |
| 5,253,801 | 10/1993 | Bernstein et al. | 229/125.35 |
| 5,269,404 | 12/1993 | Wischusen et al. . | |

*Primary Examiner*—Gary E. Elkins
*Attorney, Agent, or Firm*—J. R. McDaniel; R. L. Schmalz

[57] ABSTRACT

This invention relates to paperboard food packages. Such structures of this type, generally, have lids which can be sealed to the food package which utilizes press-applied coatings as a sealing medium.

20 Claims, 4 Drawing Sheets

CONTAINER/LID ASSEMBLY FOR PAPERBOARD FOOD PACKAGES WHICH UTILIZES PRESS-APPLIED COATINGS AS A SEALING MEDIUM

BACKGROUND OF THE INVENTION

1. Field of the Invention

This invention relates to paperboard food packages. Such structures of this type, generally, have lids which can be sealed to the food package without the use of adhesives.

1. Description of the Related Art

One or two serving portions of precooked and/or frozen food are frequently packaged for consumer distribution in paperboard trays. Such trays are folded or pressed from preprinted and die-cut bleached sulphate paperboard blanks or sheets.

Covers for these paperboard trays may take one of several forms including a top flap that is an integral continuation of the same paperboard sheet from which the tray is erected, such a top flap being crease hinged to one sidewall of the tray. Another type of lid is an independent paperboard sheet that is adhesively secured or plastic fuse bonded to a small perimeter flange folded from the upper edge of the tray sidewalls.

As additional factors to the present invention's prior art and development, it should be understood that a typical commercial food tray filling line advances at a rate of 60 to 120 units per minute. Consequently, any step or process in the continuous production line that requires a full stop of the subject unit must be accomplished in one second or less. Other processing steps are performed on a moving unit.

Moreover, once the tray is filled with the food product and the lid is positioned, the tray's inside surfaces are not accessible. Any force applied to a lid flap for sealing against a tray side wall must be less than the crushing capacity of the erected tray. Frequently, only a gentle touch is permissible.

In order to avoid a crushing of the erected tray, the prior art has relied upon both cold set and hot melt adhesives to achieve lid-to-tray seal. Exemplary of such prior art are U.S. Pat. Nos. 5,090,615 to Hopkins et al. and 5,234,159 to Lorence et al. While these two references avoid a crushing of the erected tray, each of these adhesive sealing devices carry respective adverse consequences. For example, cold set adhesives are extremely slow setting and, therefore, incompatible with a production capacity of 120 units per minute. Also, hot melt adhesives have relatively low softening temperatures which are incompatible with typical oven temperatures which are used when the food within the package is heated for consumption. These glue systems also add components to the packaging line which can add expense and time to the packaging of the contents. Finally, these glue systems add additional materials for the food packager to inventory. Therefore, a more advantageous food tray would be one which avoided the use of adhesives.

It is apparent from the above that there is a need in the art for a food tray and lid which can be easily sealed together through simplicity of parts and the uniqueness of structure, and which at least equal the sealing characteristics of the prior food trays, but which at the same time avoid the use of adhesives. It is the purpose of this invention to fulfill this and other needs in the art in a manner more apparent to the skilled artisan once given the following disclosure.

SUMMARY OF THE INVENTION

Generally speaking, this invention fulfills these needs by providing a container/lid assembly, comprising a paperboard container further comprising an outer surface having a bottom surface and a peripheral wall extending substantially upward from a first edge of the bottom surface, and an inner surface located adjacent to the peripheral wall wherein the outer surface is further comprised of a polymeric coating located on predetermined areas of the outer surface, and a lid further comprising a first and second side such that the first side includes a polymeric coating and further includes a first section which substantially overlaps the peripheral wall section of the container and a second section which is located substantially over the predetermined areas of the polymeric coating on the outer surface of the container, wherein the polymeric coatings on the container and the lid form a seal between the container and the lid when the coatings are heated.

In certain preferred embodiments, the polymeric coating on the inner container surface is made up of a thermally stable moisture barrier. Also, the polymeric coating on the lid is constructed of substantially the same thermally stable moisture barrier coating. The polymeric coating may be applied to the bottom surface of the paperboard container. Finally, the coating on the lid may be a continuous coating or a patterned coating.

In another further preferred embodiment, a container/lid assembly can be constructed which adequately protects the food contents and which at the same time avoids the use of adhesives.

The preferred container/lid assembly, according to this invention, offers the following advantages: ease of assembly; an avoidance of adhesives; excellent stability; excellent durability; and good economy. In fact, in many of the preferred embodiments, these factors of ease of assembly, avoidance of adhesives, excellent stability, and excellent durability are optimized to an extent that is considerably higher than heretofore achieved in prior, known container/lid assemblies.

The above and other features of the present invention, which will become more apparent as the description proceeds, are best understood by considering the following detailed description in conjunction with the accompany drawings, wherein like characters represent like parts throughout the several views and in which:

BRIEF DESCRIPTION OF THE DRAWINGS

FIGS. 1*a*–1*c* illustrate a container/lid assembly for a multi-compartment container, according to the present invention, wherein FIG. 1*a* illustrates the lid, FIG. 1*b* illustrates the multi-compartment container, and FIG. 1*c* illustrates an assembled container/lid assembly;

FIGS. 2*a*–2*d* illustrate a container/lid assembly for a single compartment container, according to the present invention, wherein FIG. 2*a* illustrates a lid, FIG. 2*b* illustrates a single compartment container, FIG. 2*c* illustrates an assembled container/lid assembly with the lid attached to the bottom of the container, and FIG. 2*d* illustrates another embodiment of a container/lid assembly with the lid attached to the side of the container;

FIGS. 3*a*–3*b* illustrate another embodiment of a container/lid assembly for a multi- compartment container, according to the present invention, wherein FIG. 3*a* illustrates the lid, FIG. 3*b* illustrates the multi-compartment container, FIGS. 4a–4d illustrate another embodiment of a container/lid assembly for a single compartment container, according to the present invention, wherein FIG. 4a illustrates a lid, FIG. 4b illustrates a single compartment container, FIG. 4c illustrates a completed container/lid assembly with the lid attached to the bottom of the container, and FIG. 4d illustrates another embodiment of a container/lid assembly with the lid attached to the side of the container.

DETAILED DESCRIPTION OF THE INVENTION

Figure 1A:
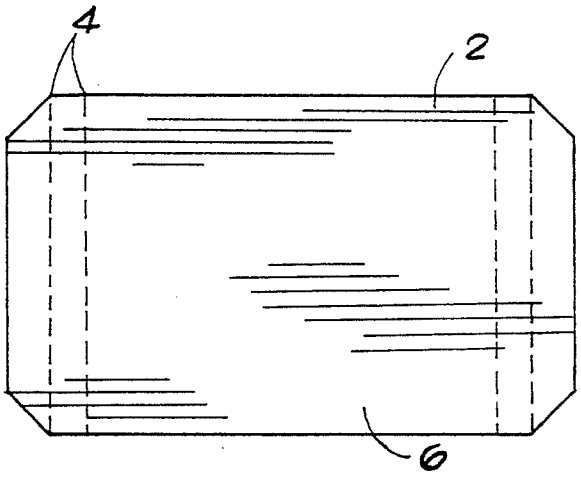
Figure 1B:
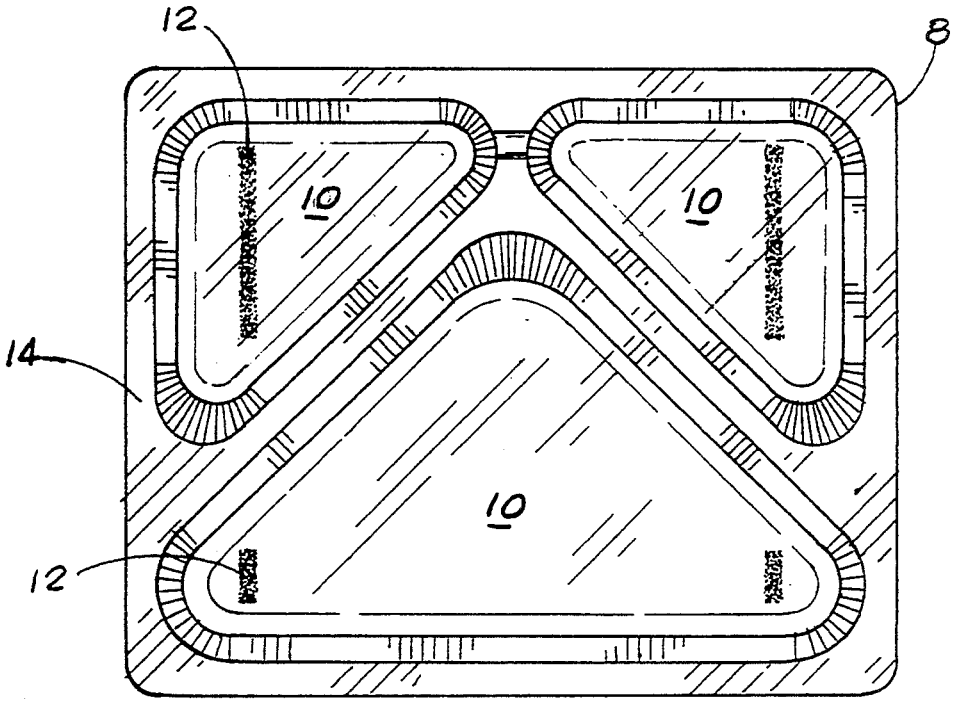
Figure 1C:
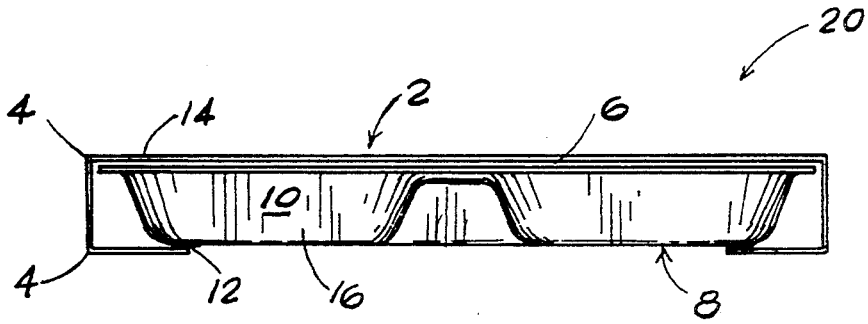

With reference first to FIGS. 1a to 1c, there is illustrated lid 2 (FIG. 1a), tray 8 (FIG. 1b), and lid/container assembly 20 (FIG. 1c). With respect to FIG. 1a, lid 2 includes in part, score lines 4 and coating 6. Coating 6, preferably, is a continuous polymeric coating. This polymeric coating should exhibit a relatively low softening temperature (below 400° F.) so that it may be heated and tack bonded on a continuous conventional conveying system traveling at typical packaging lines speed with only a gentle compression pressure being permissible to join lid 2 to tray 8. Also, the polymer coating must exhibit temperature stability above 400° F. in order to be considered for ovenable applications. Finally, the upper portion of the lid is conventionally printed with sales graphics or other such information.

With respect to tray 8, tray 8 includes, in part, compartments 10, areas 12 of the polymer coating, and flange 14. It is to be understood that the areas 12 of the polymer coating are coated with substantially the same polymer coating as coating 6 (FIG. 1a). It is also to be understood that the inside of tray 8 is conventionally coated with a continuous coating of a conventional ovenable polymer.

With respect to container/lid assembly 20 (FIG. 1c), assembly 20, includes, in part, lid 2, score lines 4, coating 6, tray 8, tray compartments 10, polymer coating 12, flange 14, and tray bottom 16. As can be seen, patterned polymer areas 12 are placed upon bottom 16 of tray 8 by use of conventional applicating techniques. Also, as can be seep in FIG. 1c, lid 2 is folded along score lines 4 and attached along flange 14 and polymeric areas 12 such that lid 2 is attached to tray 8 after the polymer coatings 6 and 12 are heated by conventional heating techniques.

The coatings that may be applied to lid 2 and tray 8 include, but are not limited to, the MW 10 product of Michelman, Inc., 9080 Shell Road, Cincinnati, Ohio. Another such source is the CARBOSET XPD-1103 product of B. F. Goodrich Company, 9911 Brecksville Road, Brecksville, Ohio.

The Michelman MW 10 product comprises an acrylic copolymer resin and high density polyethylene wax. The Goodrich CARBOSET XPD-1103 product is described as an anionic emulsion of an acrylic ester copolymer in water. CARBOSET XPD-1103 is also characterized as a styrene-acrylic copolymer emulsion containing heat activated curing mechanisms stimulated by a 250°–300° F. curing temperature.

Other coatings which are solvent-based which may work for this application include Adcote 40-3E and 33R2-AH, also produced by Morton.

Figure 2A:
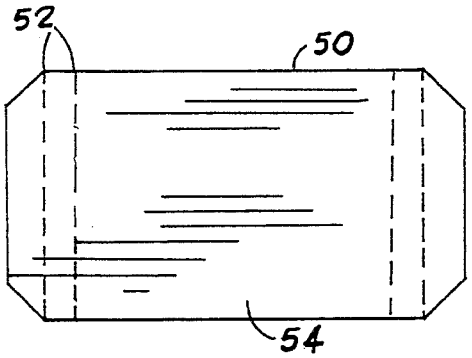
Figure 2B:
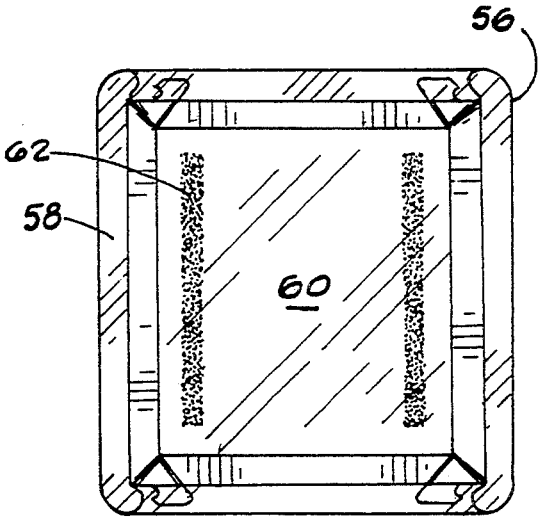
Figure 2C:
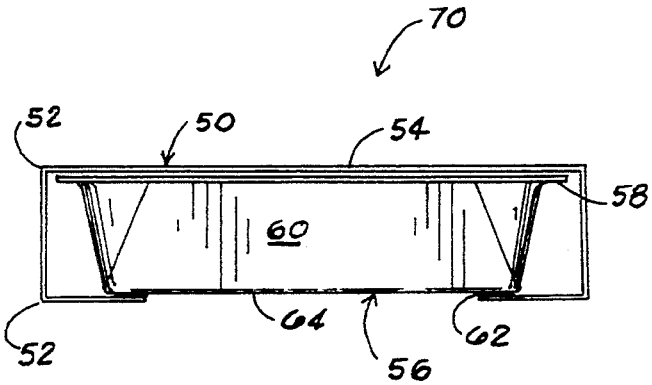
Figure 2D:
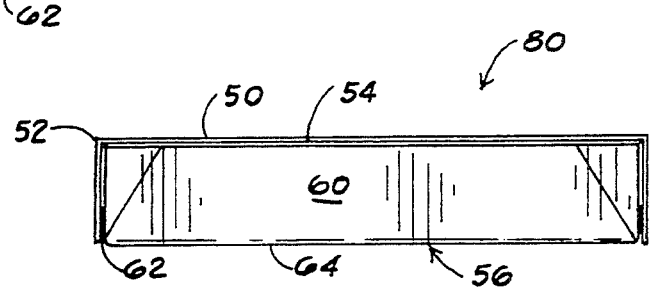

With respect to FIGS. 2a–2d, FIG. 2a shows lid 50. FIG. 2b shows single compartment tray 56. FIG. 2c shows container/lid assembly 70. Finally, FIG. 2d shows another embodiment of a container/lid assembly 80.

With respect to FIG. 2a, lid 50 includes, in part, score lines 52 and coating 54. Coating 54, preferably, is the same coating placed upon lid 2, as shown in FIG. 1a.

With respect to tray 56, tray 56 includes, in part, flange 58, tray compartment 60, and patterned polymer areas 62. Polymer areas 62, preferably, are constructed of the same material and in the same manner as patterned polymer areas 12 of FIG. 1b.

With respect to FIG. 2c, container/lid assembly 70 includes, in part, lid 50, score lines 52, polymer coating 54, tray 56, flange 58, patterned polymer areas 62, and tray bottom 64. With respect to container/lid assembly 70, lid 50 is scored and folded and attached to the bottom 64 of tray 56 by the heating polymer coating 54 and patterned polymer areas 62.

With respect to container/lid assembly 80, as shown in FIG. 2d, assembly 80 includes, in part, lid 50, score lines 52, polymer coating 54, tray 56, tray compartment area 60, patterned polymer areas 62, and tray bottom 64.

As shown in FIG. 2d, tray 56 does not include flanges. Therefore, the use of an additional score line 52 is eliminated from lid 50. Thus, patterned polymer areas 62 are placed by conventional applicating techniques along the opposite sides of tray 56. However, as with container/lid assembly 70 (FIG. 2c), lid 50 is attached to tray 56 through the heating of polymer coating 54 and patterned polymer areas 62 such that lid 50 is attached to tray 56.

Figure 3A:
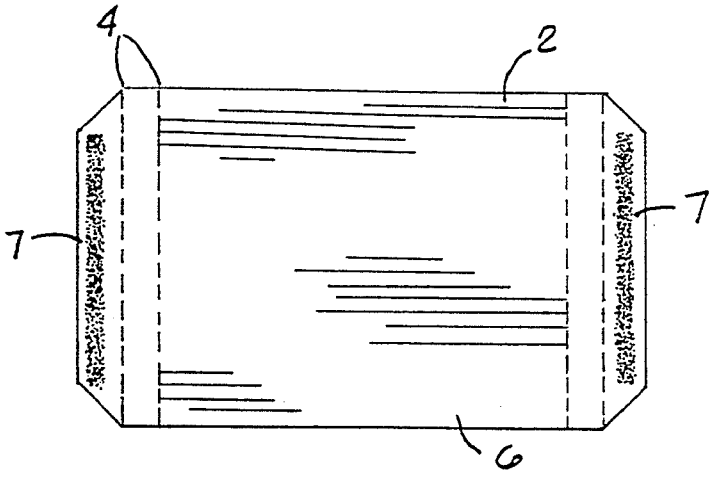
Figure 3B:
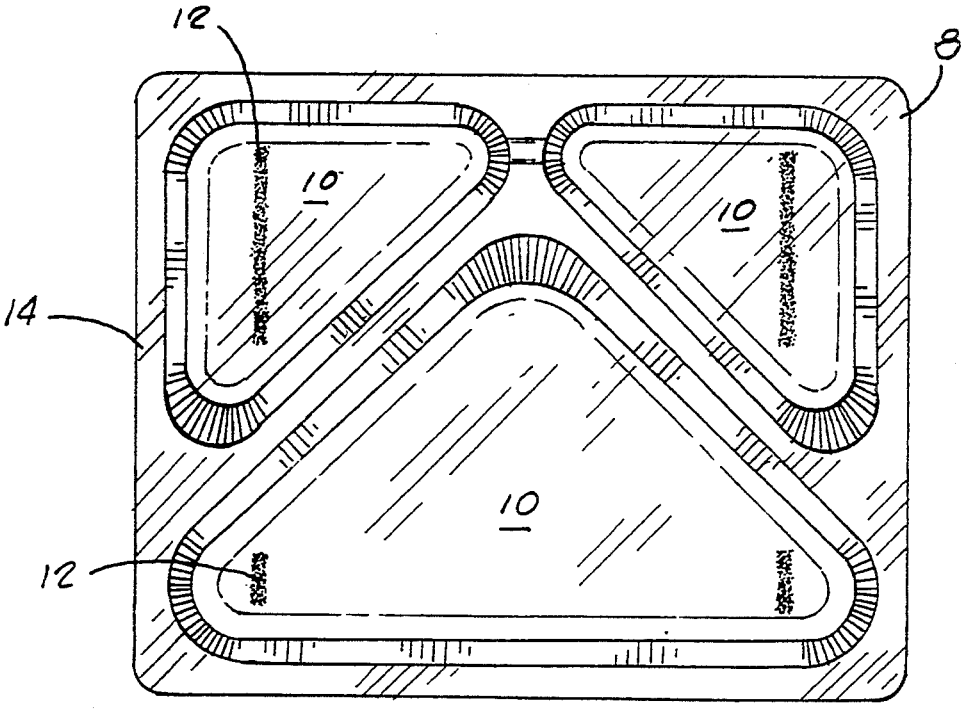
Figure 3C:
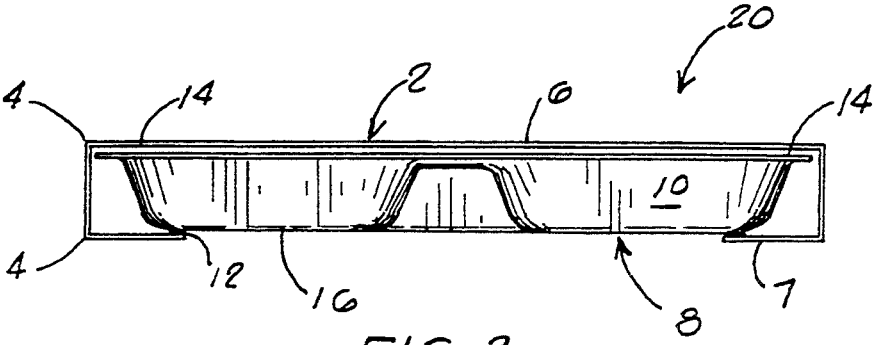
FIG. 3c illustrates an assembled container/lid assembly.

With reference to FIG. 3, FIG. 3a illustrates lid 2. FIG. 3b illustrates multi-compartment tray 8. Finally, FIG. 3c illustrates container/lid assembly 20.

As discussed earlier with respect to FIGS 1a to 1c, lid 2 (FIG. 3a) includes, in part, score lines 4, patterned polymer coating 6, and patterned polymer coatings 7. Coating 6, preferably, is the same coating as that set forth with respect to FIG. 1a. However, patterned areas 7 are located along the outer edges of lid 2 and are preferably, constructed of a different material than coating 6.

The coatings that may be applied to lid 2 in pattern areas 7 include, but are not limited to Adcote 37R972HV, 37T77 and X19-7 produced by Morton International, Inc. of Woodstock, Ill. The basic requirements of the coatings being that the polymer constituent in emulsions is solubilized by conventional acidic modification and then buffered to a pH when the acid exists as a salt. The tack temperature should be about 375° F. and the application rate should range from 0.5 lb/ream to 4.0 lbs/ream, although most applications will find an application rate of 2 to 3 lbs/ream to be preferable. The working viscosity of such emulsions may be reduced by water solvation.

With respect to FIG. 3b, tray 8 includes, in part, tray compartments 10, patterned polymer areas 12, and flange 14. Again, as with respect to FIG. 1b, tray 8 is constructed substantially the same as that described with respect to FIG. 1b. It is to be understood that the polymeric areas 12 are coated with substantially the same polymer coating as coating 7.

With respect to FIG. 3c, container/lid assembly 20 includes in part, lid 2, score lines 4, patterned polymer coating 6, patterned polymer areas 7, tray 8, tray compartments 10, patterned polymer areas 12, tray flange 14, and tray bottom 16. As discussed earlier with respect to FIG. 1c, lid 2 is secured to flange 14 and tray bottom 16 through the heating of patterned polymer coating 6, patterned polymer coatings 7 and patterned polymer coatings 12. Distinct patterned polymer areas 7 are used to attach the flaps of lid 2 to the bottom 16 of tray 8.

Figure 4A:
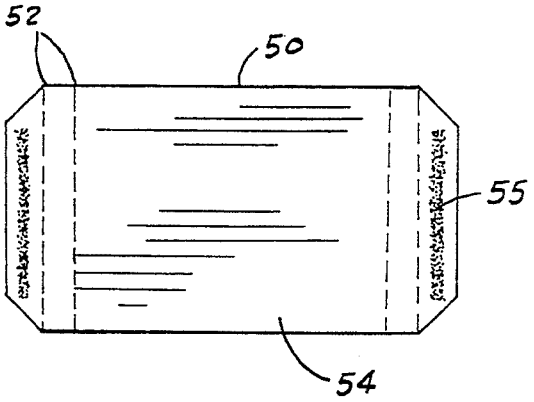

With respect to FIG. 4, FIG. 4*a* illustrates lid 50. FIG. 4*b* illustrates single compartment tray 56. FIG. 4*c* illustrates container/lid assembly 70. Finally, FIG. 4*d* illustrates another embodiment of a container/lid assembly 80.

Lid 50 includes, in part, scores line 52, patterned polymer coating 54 and patterned polymer coatings 55. Coating 54, preferably, is the same material as coating 54 earlier described with respect to FIG. 2*a*. It should be understood that coatings 54 and 55, preferably, are not the same type of coatings. Coatings 54 and 55 are applied in a patterned technique instead of a continuous coating.

Figure 4B:
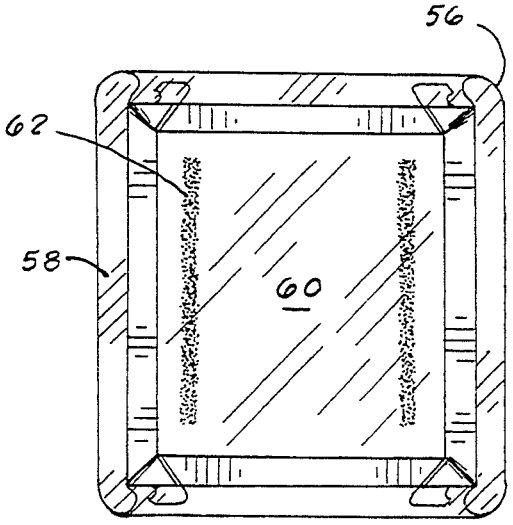
Figure 4C:
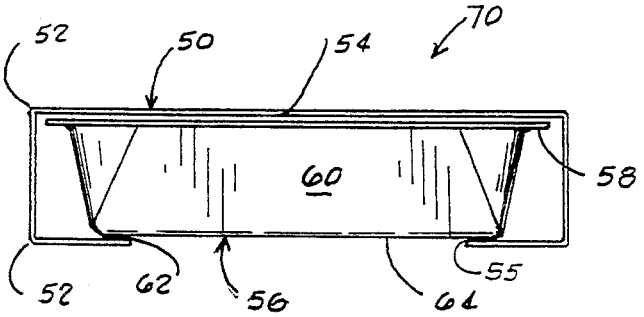
Figure 4D:
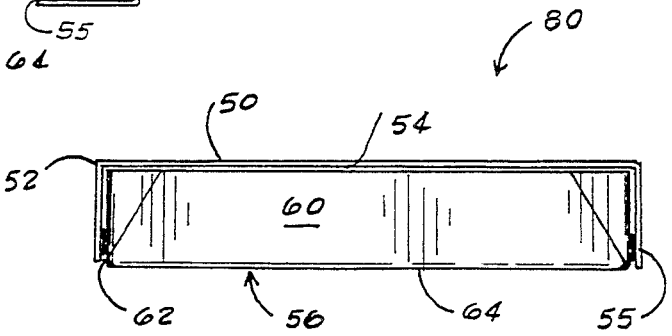

Tray 56, includes, in part, flange 58, tray compartment 60, and patterned polymer areas 62. It is to be understood that tray 56 as shown in FIG. 4*b* is substantially the same as tray 56 previously described with respect to FIG. 2*b*. It is to be understood that patterned polymer coating areas 62 are coated with substantially the same polymer coating as coating 55.

With respect to container/lid assembly 70 (FIG. 4*c*), assembly 70 includes, in part, lid 50, score lines 52, patterned coating 54, patterned coatings 55, tray 56, flange 58, tray compartment 60, patterned polymer areas 62, and tray bottom 64. Lid 50 is attached to tray 56 in substantially the same manner as is described with respect to container/lid assembly 70 of FIG. 2*c*. However, in this particular instance, instead of the continuous coating, as previously described with respect to FIG. 2*c*, there is a patterned coating 54 and patterned coatings 55. Patterned coating 54 is used to secure lid 50 to the flange 58. Patterned coatings 55 are used to secure lid 50 to the bottom 64 of tray 56.

Container/lid assembly 80 (FIG. 4*d*) includes, in part, lid 50, score lines 52, patterned coating 54, patterned coatings 55, tray 56, tray compartment 60, and patterned polymer areas 62. As discussed earlier with respect to FIG. 2*d*, tray 56 does not have flanges 58 as previously described with respect to FIG. 4*c*. Consequently, patterned areas 62 must be applied by conventional techniques to the opposite sides of tray 56. In this manner, patterned areas 55 and 62 can come in contact with each other to make a bond when heated to secure lid 50 to tray 56. It is to be understood that patterned areas 55 and 62 will be located on lid 50 and tray 56, respectively, in such a manner that patterned areas 55 and 62 will contact each other prior to a heat treatment of the various assemblies such that these patterned areas will create a bond between the lids and the trays when heated so that the lids will be attached to the trays.

Once given the above disclosure, many other features, modifications or improvements will become more apparent to the skilled artisan. Such features, modifications or improvements are, therefore, considered to be a part of this invention, the scope of which is to be determined by the following claims.

What is claimed is:

1. A container/lid assembly, wherein said assembly is comprised of:

a paperboard container further comprising an outer surface having a bottom surface and a peripheral wall extending substantially upward from a first edge of said bottom surface, and an inner surface located adjacent to said peripheral wall wherein said outer surface is further comprised of a polymeric coating located on predetermined areas of said outer surface; and a lid further comprising a first and second side such that said first side includes a polymeric coating located substantially over a first and second section of said first side such that said first section covers a vessel opening and substantially overlaps said peripheral wall of said container and said second section is located substantially over said predetermined areas of said polymeric coating on said outer surface of said container, wherein said polymeric coatings on said container and said lid form a seal between said container and said lid when said coatings are heated.

2. The container/lid assembly, as in claim 1, wherein said container is further comprised of:

a peripheral flange extending substantially outward from said peripheral wall.

3. The container/lid assembly, as in claim 1, wherein said inner surface of said container is further comprised of:

a continuous polymeric coating.

4. The container/lid assembly, as in claim 1, wherein said polymer coating located on said predetermined areas of said outer surface of said container is substantially located on said bottom surface of said container.

5. The container/lid assembly, as in claim 1, wherein said polymer coating located on said predetermined areas of said outer surface of said container is substantially located on a peripheral surface of said container.

6. The container/lid assembly, as in claim 1, wherein said polymeric coating located on said predetermined areas of said outer surface of said container is further comprised of:

a polymeric material having a tack temperature less than 400° F.

7. The container/lid assembly, as in claim 1, wherein said polymeric coating located on said lid is further comprised of:

a polymeric material having a tack temperature less than 400° F.

8. The container/lid assembly, as in claim 3, wherein said polymeric coating located on said inner surface of said container means is further comprised of:

a polymeric material having a temperature stability of at least 400° F.

9. The container/lid assembly, as in claim 1, wherein said polymeric coating located said lid is further comprised of:

a polymeric material having a temperature stability of at least 400° F.

10. The container/lid assembly, as in claim 1, wherein said polymeric coating on said first section of said lid is further comprised of:

a first polymeric coating.

11. The container/lid assembly, as in claim 10, wherein said polymeric coating on said second section of said lid is further comprised of:

a second polymeric coating.

12. A container/lid assembly, wherein said assembly is comprised of:

a paperboard container further comprising an outer surface having a bottom surface and a peripheral wall extending substantially upward from a first edge of said bottom surface, an inner surface located adjacent to said peripheral wall wherein said outer surface is further comprised of a polymeric coating located on predetermined areas of said outer surface and a peripheral flange extending substantially outward from said peripheral wall of said container; and a lid further comprising a first and second side such that said first side includes a polymeric coating located substantially over a first and second section of said first side such that said first section covers a vessel opening and substantially overlaps said peripheral flange of said container and said second section is located substantially over said predetermined areas of said polymeric coating on said outer surface of said container, wherein said polymeric coatings on said container and said lid form a seal between said container and said lid when said coatings are heated.

13. The container/lid assembly, as in claim 12, wherein said inner surface of said container is further comprised of:

a continuous polymeric coating.

14. The container/lid assembly, as in claim 12, wherein said polymer coating located on said predetermined areas of said outer surface of said container is substantially located on said bottom surface of said container.

15. The container/lid assembly, as in claim 12, wherein said polymeric coating located on said predetermined areas of said outer surface of said container is further comprised of:

a polymeric material having a tack temperature less than 400° F.

16. The container/lid assembly, as in claim 12, wherein said polymeric coating located on said lid is further comprised of:

a polymeric material having a tack temperature less than 400° F.

17. The container/lid assembly, as in claim 13, wherein said polymeric coating located on said inner surface of said container is further comprised of:

a polymeric material having a temperature stability of at least 400° F.

18. The container/lid assembly, as in claim 12, wherein said polymeric coating located on said lid means is further comprised of:

a polymeric material having a temperature stability of at least 400° F.

19. The container/lid assembly, as in claim 12, wherein said polymeric coating on said first section of said lid is further comprised of:

a first polymeric coating.

20. The container/lid assembly, as in claim 13, wherein said polymeric coating on said second section of said lid is further comprised of:

a second polymeric coating.

* * * * *

UNITED STATES PATENT AND TRADEMARK OFFICE

CERTIFICATE OF CORRECTION

PATENT NO. : 5,421,510

DATED : Jun. 6, 1995

INVENTOR(S) : Barry G. Calvert

It is certified that error appears in the above-indentified patent and that said Letters Patent is hereby corrected as shown below:

Column 3, line 45, change "seep" to --seen--. Column 8, line 17 (Claim 18, line 3), delete "means". Column 8, line 24 (Claim 20, line 1), change "13" to --19--.

Signed and Sealed this

Fifteenth Day of August, 1995

Bruce Lehman

*Attest:*

BRUCE LEHMAN

*Attesting Officer*

*Commissioner of Patents and Trademarks*